US008912422B2

(12) United States Patent
Nakae et al.

(10) Patent No.: US 8,912,422 B2
(45) Date of Patent: Dec. 16, 2014

(54) ELECTRONIC STRINGED INSTRUMENT, MUSICAL SOUND GENERATION METHOD AND STORAGE MEDIUM

(71) Applicant: Casio Computer Co., Ltd., Shibuya-ku, Tokyo (JP)

(72) Inventors: Tetsuichi Nakae, Tokyo (JP); Tatsuya Dejima, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 14/145,227

(22) Filed: Dec. 31, 2013

(65) Prior Publication Data

US 2014/0190337 A1 Jul. 10, 2014

(30) Foreign Application Priority Data

Jan. 8, 2013 (JP) ..... 2013-001418

(51) Int. Cl.
*G10H 1/06* (2006.01)
*G10H 1/18* (2006.01)
*G10H 3/18* (2006.01)

(52) U.S. Cl.
CPC ..... *G10H 3/18* (2013.01)
USPC ..... 84/735; 84/722

(58) Field of Classification Search
CPC ..... G10H 3/18; G10H 3/186
USPC ..... 84/735, 722
See application file for complete search history.

(56) References Cited

U.S. PATENT DOCUMENTS 4,760,767 A * 8/1988 Tsurubuchi ..... 84/646
5,024,134 A * 6/1991 Uchiyama ..... 84/654
7,928,309 B2 * 4/2011 Vallancourt et al. ..... 84/615

FOREIGN PATENT DOCUMENTS

JP 3704851 B2 10/2005

* cited by examiner

*Primary Examiner* — Jeffrey Donels
(74) *Attorney, Agent, or Firm* — Holtz, Holtz, Goodman & Chick PC

(57) ABSTRACT

A CPU 41 determines whether or not the detected level of string picking strength exceeds a predetermined first level, and in a case of determining that the predetermined first level is exceeded, determines whether or not a condition is satisfied that the number of the frets 23 in contact with the string 22 detected as a picked string is a predetermined number or more (10 or more) while the frets in contact therewith as above are located within a predetermined area from the bridge 16 (the fret number 18 or higher). In a case where it is determined that the condition is satisfied, the CPU 41 instructs the connected sound source 45 to generate a predefined slap sound.

21 Claims, 11 Drawing Sheets

ELECTRONIC STRINGED INSTRUMENT, MUSICAL SOUND GENERATION METHOD AND STORAGE MEDIUM

This application is based upon and claims the benefit of priority from the prior Japanese Patent Application No. 2013-1418, filed Jan. 8, 2013, and the entire contents of which are incorporated herein by reference.

BACKGROUND OF THE INVENTION

1. Field of the Invention

The present invention relates to an electronic stringed instrument, a musical sound generation method and a storage medium.

2. Related Art

An electronic stringed instrument is conventionally known that produces tapping harmonics according to a state of a switch on a left-hand side (refer to Japanese Patent No. 3704851). This electronic stringed instrument determines a pitch difference with respect to pitch specified by a pitch specification operator prior to pitch specified by a pitch specification operator having tapping detected by a tapping determination unit, and a harmonics generation unit determines whether or not the pitch difference is coincident with a predetermined pitch difference, thereby generating predetermined harmonics corresponding to the pitch difference.

However, in the electronic stringed instrument of Japanese Patent No. 3704851, it is impossible to realize slapping that obtains a percussive sound by beating a fingerboard with a string and which is heavily used with an actual stringed instrument.

SUMMARY OF THE INVENTION

The present invention has been realized in consideration of this type of situation, and it is an object of the present invention to allow slapping that obtains a percussive sound by beating a fingerboard with a string and which is heavily used with an actual stringed instrument.

In order to achieve the above-mentioned object, an electronic stringed instrument according to an aspect of the present invention includes:

a plurality of strings stretched above a fingerboard unit provided with a plurality of frets;

a state detection unit that detects a state between each of the plurality of frets and each of the plurality of strings;

a string picking detection unit that detects picking of any of the plurality of strings while detecting strength of the detected string picking;

a level determination unit that determines whether or not the level of string picking strength detected by the string picking detection unit exceeds a predetermined first level;

a condition determination unit that determines, when the level determination unit determines that the predetermined first level is exceeded, whether or not a condition is satisfied that there are a plurality of frets simultaneously in contact with a string detected as a picked string by the string picking detection unit through the state detection unit; and a slap sound generation instruction unit that instructs, when the condition determination unit determines that the condition is satisfied, a connected sound source to generate a predefined slap sound.

DETAILED DESCRIPTION OF THE INVENTION

Descriptions of embodiments of the present invention are given below, using the drawings.

Overview of Electronic Stringed Instrument 1

Figure 1:
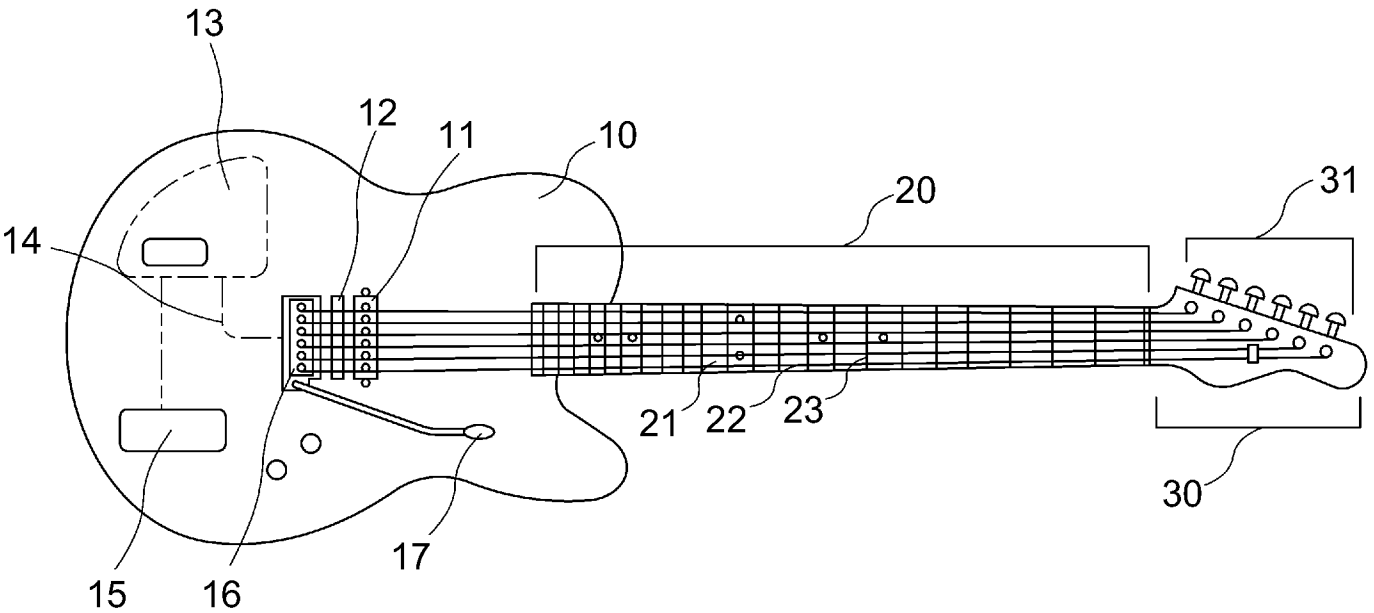
FIG. 1 is a front view showing an appearance of an electronic stringed instrument of the present invention.

First, a description for an overview of an electronic stringed instrument 1 as an embodiment of the present invention is given with reference to FIG. 1.

FIG. 1 is a front view showing an appearance of the electronic stringed instrument 1. As shown in FIG. 1, the electronic stringed instrument 1 is divided roughly into a body 10, a neck 20 and a head 30.

The head 30 has a threaded screw 31 mounted thereon for winding one end of a steel string 22, and the neck 20 has a fingerboard 21 with a plurality of frets 23 embedded therein. It is to be noted that in the present embodiment, provided are 6 pieces of the strings 22 and 22 pieces of the frets 23. 6 pieces of the strings 22 are associated with string numbers, respectively. The thinnest string 22 is numbered "1". The string number becomes higher in order that the string 22 becomes thicker. 22 pieces of the frets 23 are associated with fret numbers, respectively. The fret 23 closest to the head 30 is numbered "1" as the fret number. The fret number of the arranged fret 23 becomes higher as getting farther from the head 30 side.

The body 10 is provided with: a bridge 16 having the other end of the string 22 attached thereto; a normal pickup 11 that detects vibration of the string 22; a hex pickup 12 that independently detects vibration of each of the strings 22; a tremolo arm 17 for adding a tremolo effect to sound to be emitted; electronics 13 built into the body 10; a cable 14 that connects each of the strings 22 to the electronics 13; and a display unit 15 for displaying the type of timbre and the like.

Figure 2:
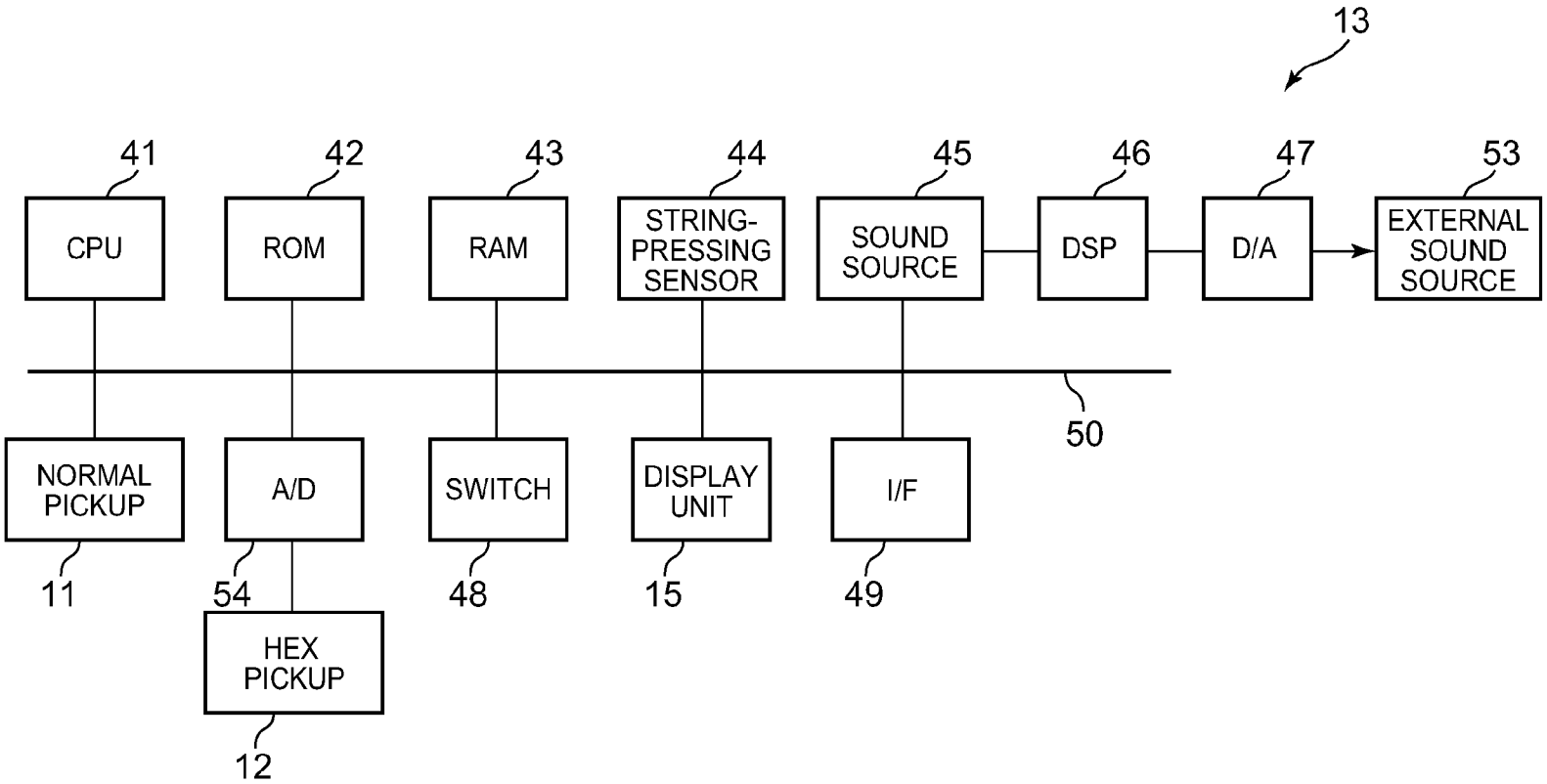
FIG. 2 is a block diagram showing an electronics hardware configuration constituting the above-described electronic stringed instrument.

FIG. 2 is a block diagram showing a hardware configuration of the electronics 13. The electronics 13 have a CPU (Central Processing Unit) 41, a ROM (Read Only Memory) 42, a RAM (Random Access Memory) 43, a string-pressing sensor 44, a sound source 45, the normal pickup 11, an A/D (analog/digital converter) 54, a switch 48, the display unit 15 and an I/F (interface) 49, which are connected via a bus 50 to one another. It is to be noted that the A/D (analog/digital converter) 54 is connected to the hex pickup 12.

Additionally, the electronics 13 include a DSP (Digital Signal Processor) 46 and a D/A (digital/analog converter) 47.

The CPU 41 executes various processing according to a program recorded in the ROM 42 or a program loaded into the RAM 43 from a storage unit (not shown in the drawing).

In the RAM 43, data and the like required for executing various processing by the CPU 41 are appropriately stored.

The string-pressing sensor 44 detects which number of the fret is pressed by which number of the string. The string-pressing sensor 44 includes the type for detecting electrical contact of the string 22 (refer to FIG. 1) with the fret 23 (refer to FIG. 1) to detect a string-pressing position, and the type for detecting a string-pressing position based on output from an electrostatic sensor described below.

The sound source 45 generates waveform data of a musical sound instructed to be generated, for example, through MIDI (Musical Instrument Digital Interface) data, and outputs an audio signal obtained by D/A converting the waveform data to an external sound source 53 via the DSP 46 and the D/A 47, thereby giving an instruction to generate and mute the sound. It is to be noted that the external sound source 53 includes an amplifier circuit (not shown in the drawing) for amplifying the audio signal output from the D/A 47 for outputting, and a speaker (not shown in the drawing) for emitting a musical sound by the audio signal input from the amplifier circuit.

The normal pickup 11 converts the detected vibration of the string 22 (refer to FIG. 1) to an electric signal, and outputs the electric signal to the CPU 41.

The hex pickup 12 converts the detected independent vibration of each of the strings 22 (refer to FIG. 1) to an electric signal, and outputs the electric signal to the CPU 41.

The switch 48 outputs to the CPU 41 an input signal from various switches (not shown in the drawing) mounted on the body 10 (refer to FIG. 1).

The display unit 15 displays the type of timbre and the like to be generated.

Figure 3:
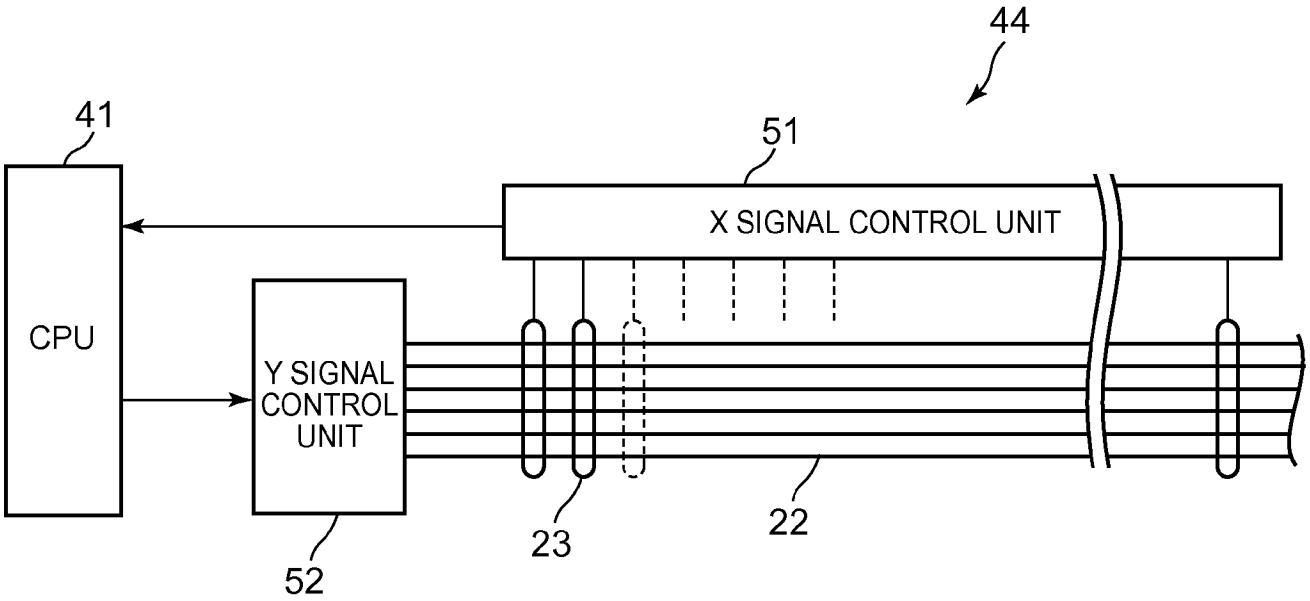
FIG. 3 is a schematic diagram showing a signal control unit of a string-pressing sensor.

FIG. 3 is a schematic diagram showing a signal control unit of the string-pressing sensor 44.

In the type of the string-pressing sensor 44 for detecting an electrical contact location of the string 22 with the fret 23 as a string-pressing position, a Y signal control unit 52 supplies a signal received from the CPU 41 to each of the strings 22. An X signal control unit 51 outputs, in response to reception of a signal supplied to each of the strings 22 in each of the frets 23 by time division, a fret number of the fret 23 in electrical contact with each of the strings 22 to the CPU 41 (refer to FIG. 2) together with the number of the string in contact therewith, as string-pressing position information.

In the type of the string-pressing sensor 44 for detecting a string-pressing position based on output from an electrostatic sensor, the Y signal control unit 52 sequentially specifies any of the strings 22 to specify an electrostatic sensor corresponding to the specified string. The X signal control unit 51 specifies any of the frets 23 to specify an electrostatic sensor corresponding to the specified fret. In this way, only the simultaneously specified electrostatic sensor of both the string 22 and the fret 23 is operated to output a change in an output value of the operated electrostatic sensor to the CPU 41 (refer to FIG. 2) as string-pressing position information.

Figure 4:
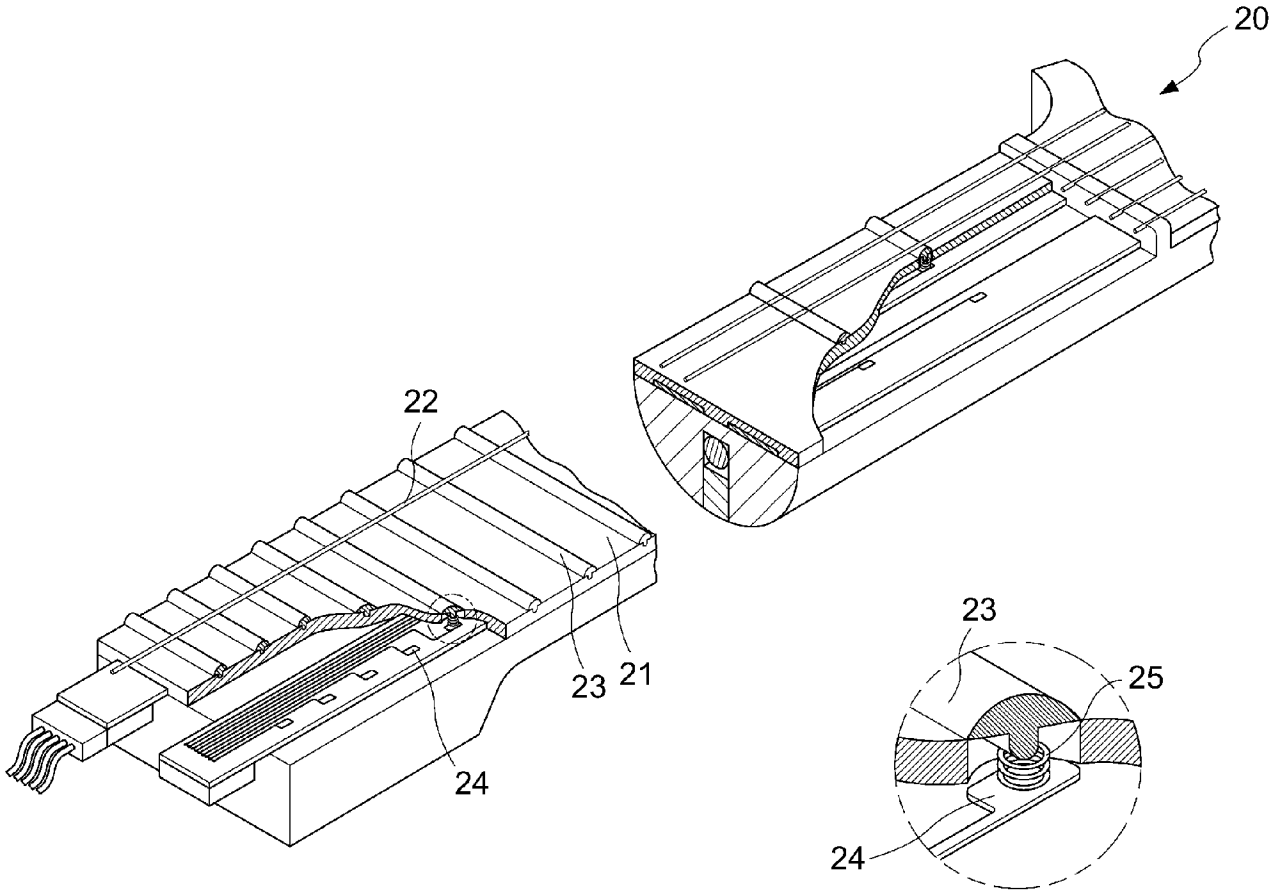
FIG. 4 is a perspective view of a neck applied with the type of string-pressing sensor for detecting electrical contact of a string with a fret.

FIG. 4 is a perspective view of the neck 20 applied with the type of string-pressing sensor 44 for detecting electrical contact of the string 22 with the fret 23.

In FIG. 4, a spring 25 is used to connect the fret 23 to a neck PCB (Poly Chlorinated Biphenyl) 24 arranged under the fingerboard 21. The fret 23 is electrically connected to the neck PCB 24 so as to detect conduction by contact of the string 22 with the fret 23, and a signal indicating which number of the string is in electrical contact with which number of the fret is sent to the CPU 41.

Figure 5:
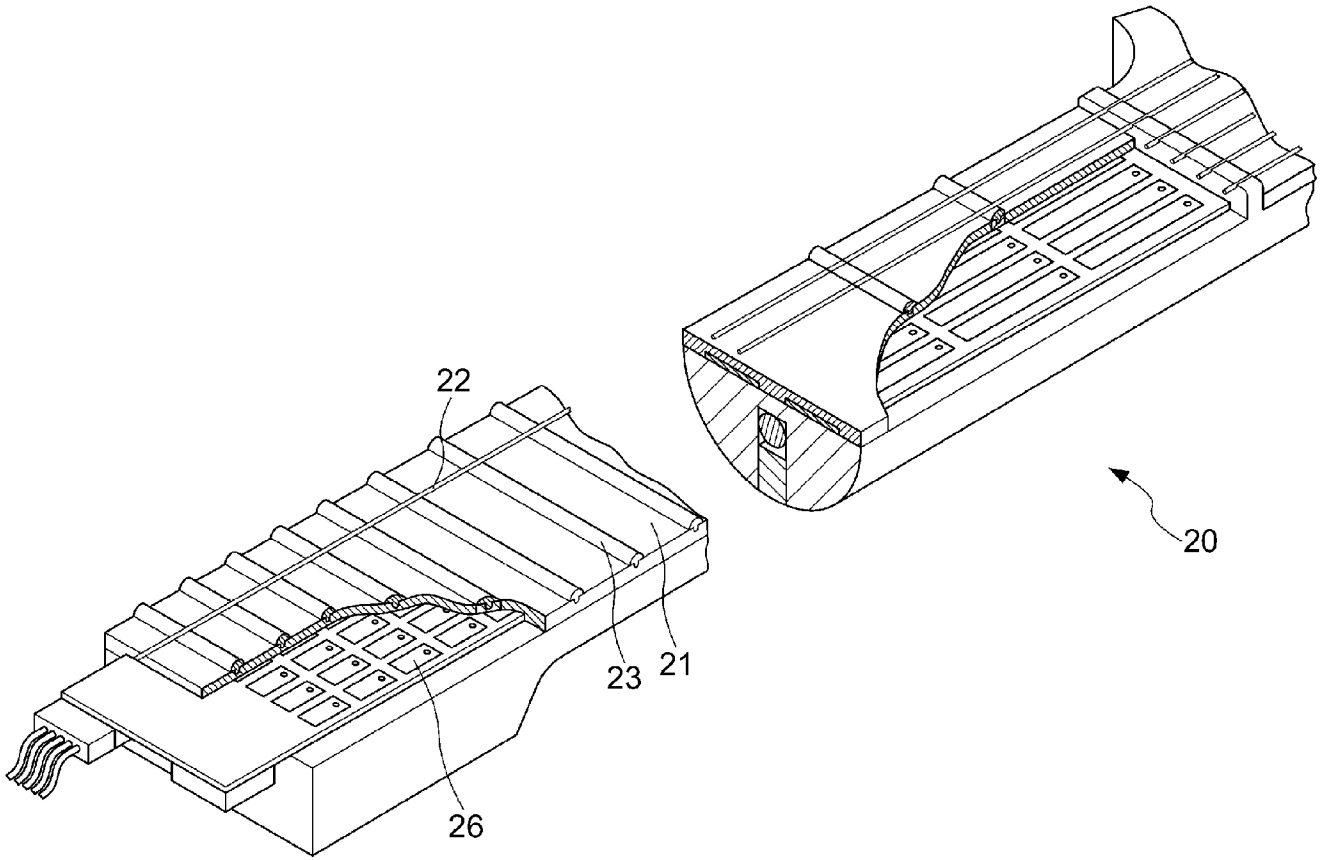
FIG. 5 is a perspective view of a neck applied with the type of a string-pressing sensor for detecting string-pressing without detecting contact of the string with the fret based on output from an electrostatic sensor.

FIG. 5 is a perspective view of the neck 20 applied with the type of the string-pressing sensor 44 for detecting string-pressing without detecting contact of the string 22 with the fret 23 based on output from an electrostatic sensor.

In FIG. 5, an electrostatic pad 26 as an electrostatic sensor is arranged under the fingerboard 21 in association with each of the strings 22 and each of the frets 23. That is, in the case of 6 strings x 22 frets like the present embodiment, electrostatic pads are arranged in 144 locations. These electrostatic pads 26 detect electrostatic capacity when the string 22 approaches the fingerboard 21, and sends the electrostatic capacity to the CPU 41. The CPU 41 detects the string 22 and the fret 23 corresponding to a string-pressing position based on the sent value of the electrostatic capacity.

Main Flow

Figure 6:
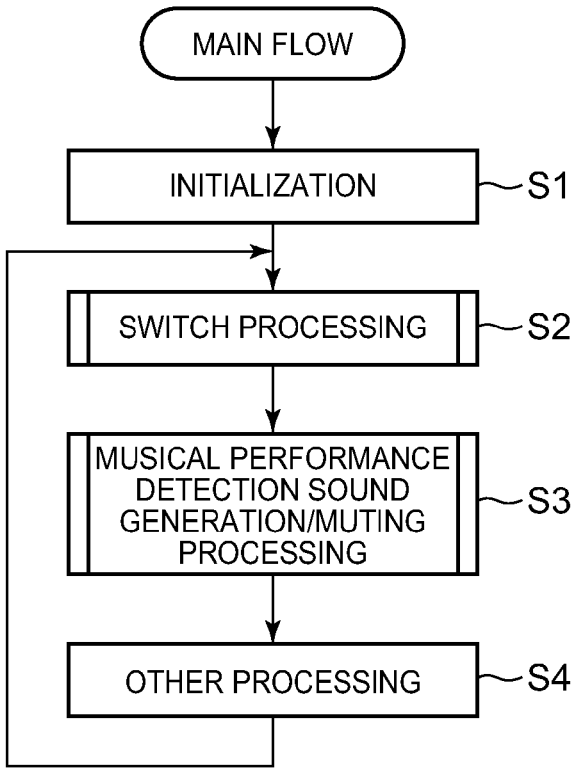
FIG. 6 is a flowchart showing a main flow executed in the electronic stringed instrument according to the present embodiment.

FIG. 6 is a flowchart showing a main flow executed in the electronic stringed instrument 1 according to the present embodiment.

Initially, in step S1, the CPU 41 is powered to be initialized. In step S2, the CPU 41 executes switch processing (described below in FIG. 7). In step S3, the CPU 41 executes musical performance detection sound generation/muting processing (described below in FIG. 9). In step S4, the CPU 41 executes other processing. In the other processing, the CPU 41 executes, for example, processing for displaying a name of an output chord on the display unit 15. After the processing of step S4 is finished, the CPU 41 advances processing to step S2 to repeat the processing of steps S2 up to S4.

Switch Processing

Figure 7:
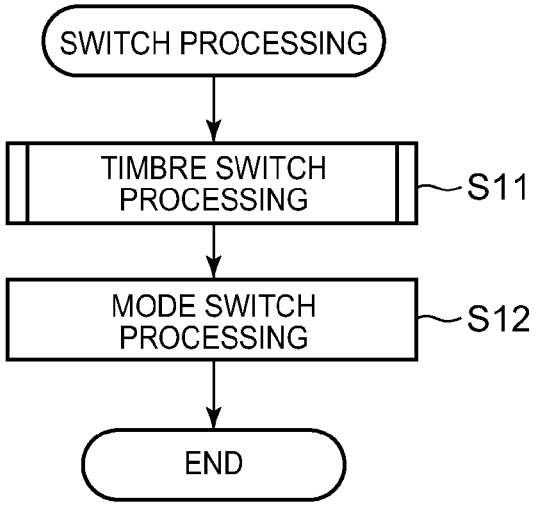
FIG. 7 is a flowchart showing switch processing executed in the electronic stringed instrument according to the present embodiment.

FIG. 7 is a flowchart showing switch processing executed in the electronic stringed instrument 1 according to the present embodiment.

Initially, in step S11, the CPU 41 executes timbre switch processing (described below in FIG. 8). In step S12, the CPU 41 executes mode switch processing. In the mode switch processing, the CPU 41 sets, in response to a signal from the switch 48, any mode of a mode of performing sound generation detection processing in FIG. 10, a mode of performing sound generation detection processing in FIG. 11 and a mode of performing sound generation detection processing in FIG. 12, among sound generation detection processing described below. After the processing of step S12 is finished, the CPU 41 finishes the switch processing.

Timbre Switch Processing

Figure 8:
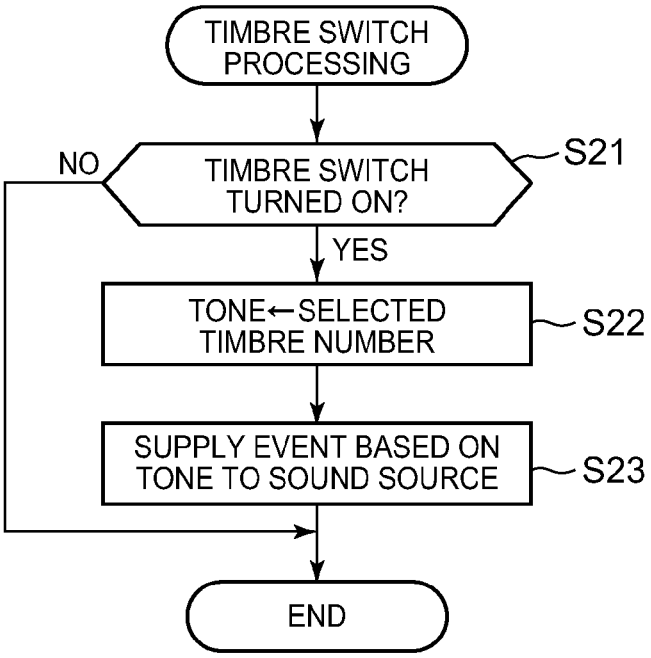
FIG. 8 is a flowchart showing timbre switch processing executed in the electronic stringed instrument according to the present embodiment.

FIG. 8 is a flowchart showing timbre switch processing executed in the electronic stringed instrument 1 according to the present embodiment.

Initially, in step S21, the CPU 41 determines whether or not a timbre switch (not shown in the drawing) is turned on. When it is determined that the timbre switch is turned on, the CPU 41 advances processing to step S22, and when it is determined that the switch is not turned on, the CPU 41 finishes the timbre switch processing. In step S22, the CPU 41 stores in a variable TONE a timbre number corresponding to timbre specified by the timbre switch. In step S23, the CPU 41 supplies an event based on the variable TONE to the sound source 45. Thereby, timbre to be generated is specified in the sound source 45. After the processing of step S23 is finished, the CPU 41 finishes the timbre switch processing.

Musical Performance Detection Sound Generation/Muting Processing

Figure 9:
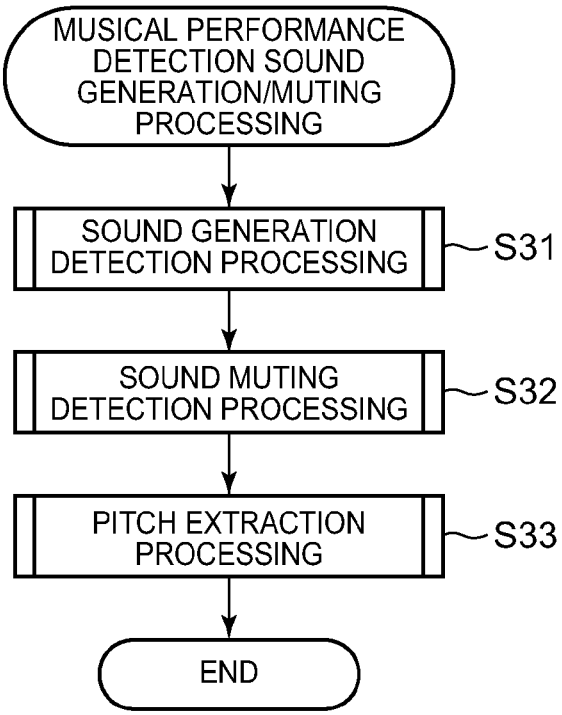
FIG. 9 is a flowchart showing musical performance detection sound generation/muting processing executed in the electronic stringed instrument according to the present embodiment.

FIG. 9 is a flowchart showing musical performance detection sound generation/muting processing executed in the electronic stringed instrument 1 according to the present embodiment.

Initially, in step S31, the CPU 41 executes sound generation detection processing (described below in FIG. 10, FIG. 11 and FIG. 12). In step S32, the CPU 41 executes sound muting detection processing (described below in FIG. 13). In step S33, the CPU 41 executes pitch extraction processing (described below in FIG. 14). After the processing of step S33 is finished, the CPU 41 finishes the musical performance detection sound generation/muting processing.

Sound Generation Detection Processing

Figure 10:
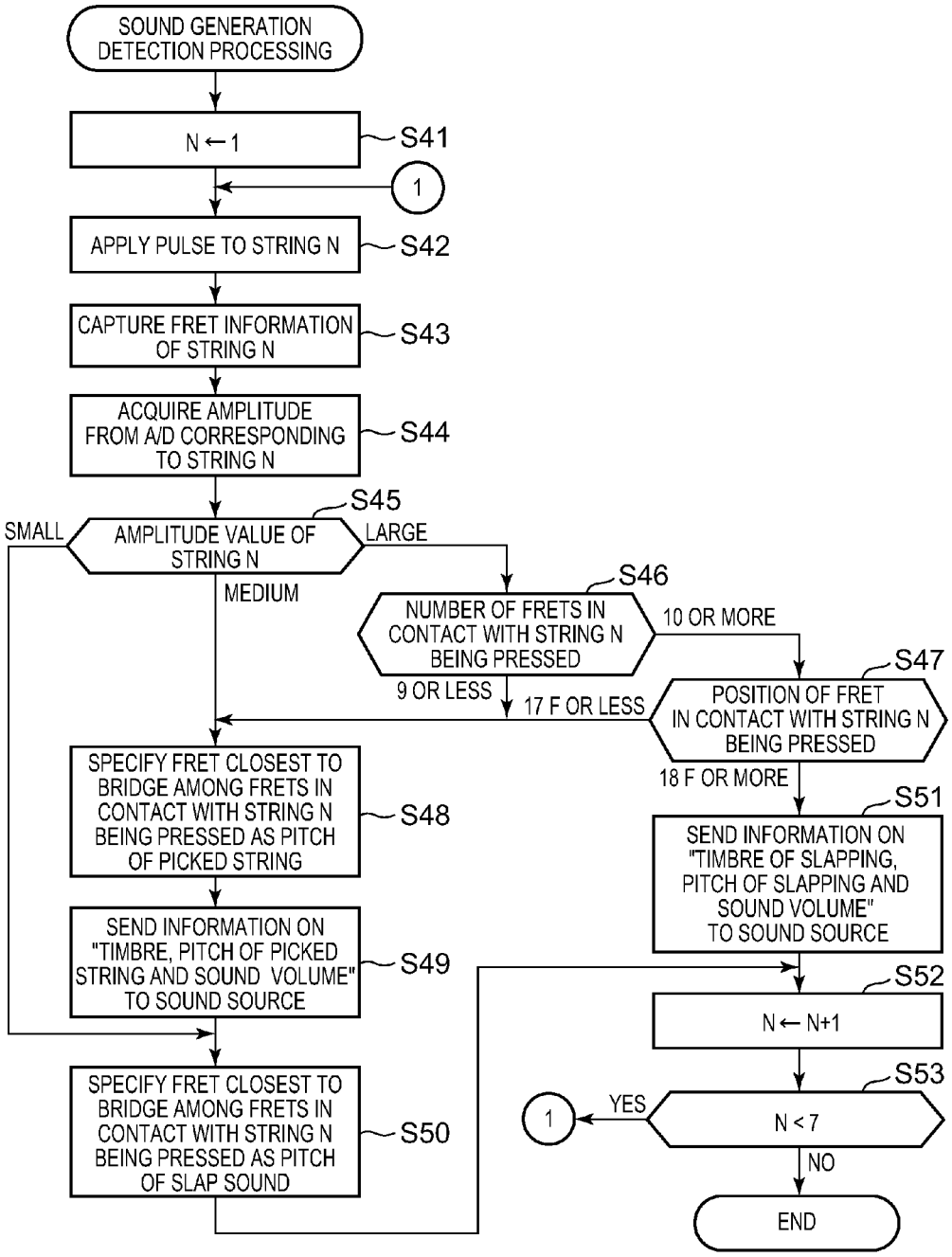
FIG. 10 is a flowchart showing sound generation detection processing executed in the electronic stringed instrument according to the present embodiment.

FIG. 10 is a flowchart showing sound generation detection processing (processing of step S31 in FIG. 9) executed in the electronic stringed instrument 1 according to the present embodiment. In this sound generation detection processing, the type of the string-pressing sensor 44 for detecting electrical contact of a string with a fret is used.

Initially, in step S41, the CPU 41 sets a variable N to 1. In step S42, the CPU 41 applies a pulse to the string 22 of a string number N. In step S43, the CPU 41 captures fret information of the string number N. Specifically, the CPU 41 acquires information on a fret number of the fret 23 in electrical contact with the string 22 of the string number N. In step S64, the CPU 41 acquires an amplitude value from the A/D 54 corresponding to the string 22 of the string number N.

In step S45, the CPU 41 differentiates a transition destination of processing according to whether an amplitude value of the string 22 of the string number N is large, medium or small. Here, a large amplitude value indicates that an amplitude value is a first threshold or more. Moreover, a medium amplitude value indicates that an amplitude value is less than the first threshold and a second threshold or more. Furthermore, a small amplitude value indicates that an amplitude value is less than the second threshold. In a case where an amplitude value is large, the CPU 41 determines that slapping is possibly performed, and advances processing to step S46. In a case where an amplitude value is medium, the CPU 41 determines that slapping is not performed and a standard playing style is used, thus advances processing to step S48. In a case where an amplitude value is small, the CPU 41 determines that string picking is not performed, and advances processing to step S50.

Here, slapping is a playing style in which large string amplitude is added beyond the strength of a standard playing style of picking a string, and with the amplitude, a string comes into contact with a fret or a fingerboard impulsively and over a wide area, so that unique timbre is generated. From microscopic observation of contact of a string with a fret in slapping, it is found that a phenomenon occurs in which the string comes into contact with the fret simultaneously over a wide area. That is, after a string is pressed, many areas other than the location in which the string is pressed are to come into contact with a fret simultaneously.

In step S46, the CPU 41 determines, in a case where there are 10 pieces or more of the frets 23 in electrical contact with the string 22 of the string number N, that slapping is possibly performed, and advances processing to step S47. On the other hand, in a case where there are 9 pieces or less of the frets 23 in contact therewith as mentioned above, the CPU 41 determines that slapping is not performed and a standard playing style is used, so advances processing to step S48. In step S47, in a case where there is the fret 23 numbered 18 or higher among 10 pieces or more of the frets 23 in contact with the string 22 of the string number N, the CPU 41 determines that slapping is performed, and advances processing to step S51. On the other hand, in step S47, in a case where there is no fret 23 numbered 18 or higher among 10 pieces or more of the frets 23 described above, the CPU 41 determines that slapping is not performed and a standard playing style is used, so advances processing to step S48. When slapping is generally performed, a string close to a bridge (string with respect to a fret number 18 or higher) is to come into contact with many frets, the processing of step S47 is thus performed.

In step S51, the CPU 41 sends information on timbre of slapping, pitch of slapping and sound volume to the sound source 45, and advances processing to step S52.

In step S48, the CPU 41 specifies, as pitch of string picking, pitch corresponding to the fret 23 closest to the bridge 16 (that is, the fret 23 of the highest fret number) among the frets 23 in contact with the string 22 of the string number N. In step S49, information on timbre, pitch of string picking and sound volume is sent to the sound source 45.

In step S50, as pitch of slapping, pitch corresponding to the fret 23 closest to the bridge 16 (that is, the fret 23 of the highest fret number) among the frets 23 in contact with the string 22 of the string number N is specified. In step S52, the CPU 41 increments N by 1. In step S53, the CPU 41 determines whether or not N is smaller than 7, and in a case where determination is YES, determines that contact of all strings with the fret 23 is not detected, and advances processing to step S42. On the other hand, in a case where determination is NO in step S53, the CPU 41 finishes the sound generation detection processing.

Sound Generation Detection Processing (First Variation)

Figure 11:
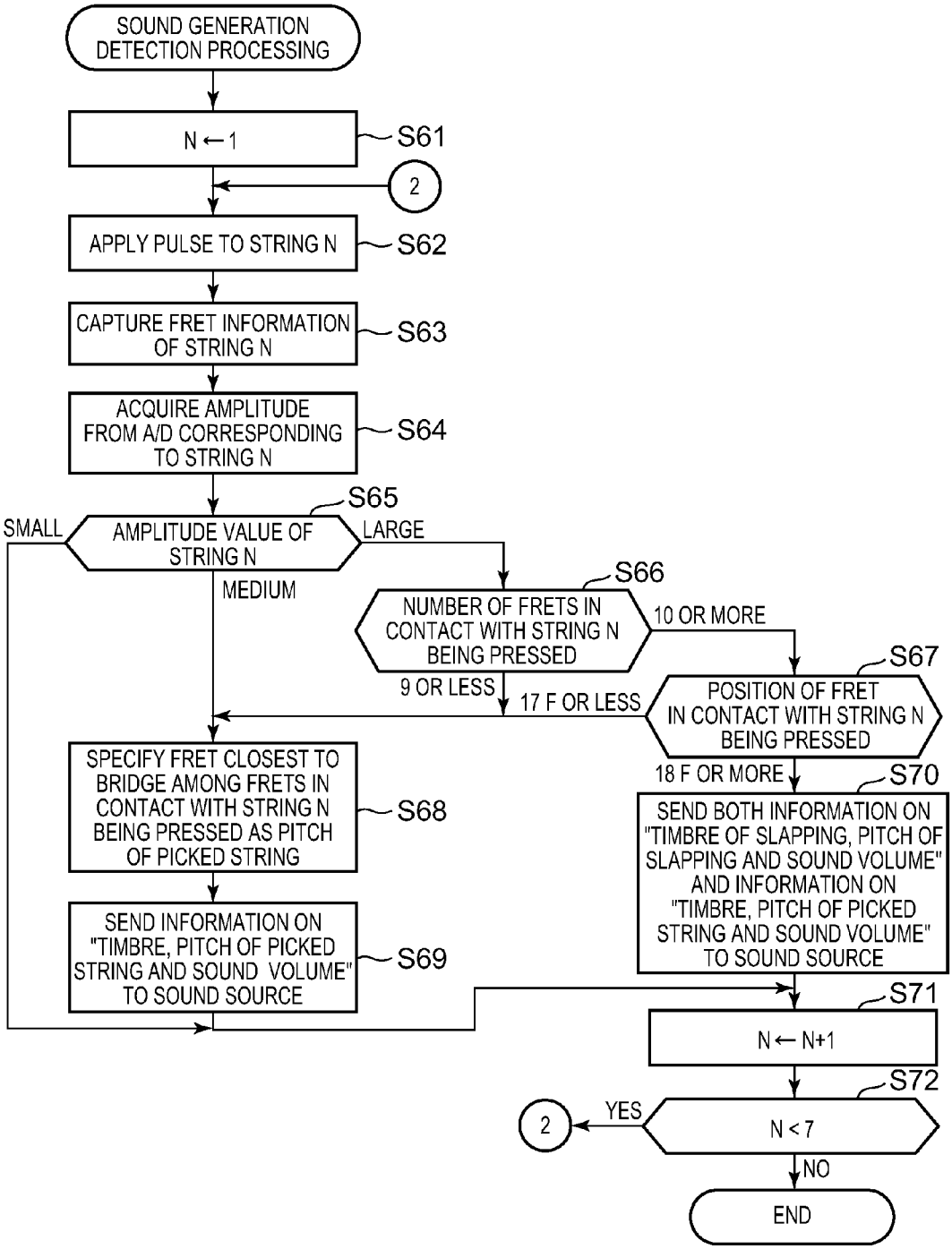
FIG. 11 is a flowchart showing a first variation of sound generation detection processing executed in the electronic stringed instrument according to the present embodiment.

FIG. 11 is a flowchart showing a first variation of sound generation detection processing (processing of step S31 in FIG. 9) executed in the electronic stringed instrument 1 according to the present embodiment. In the sound generation detection processing, the type of the string-pressing sensor 44 for detecting electrical contact of a string with a fret is used.

In FIG. 11, details of processing other than step S70 are the same as those of the sound generation detection processing in FIG. 10. Explanation is thus omitted. That is, details of processing of steps S61 up to S69 in FIG. 11 are the same as details of the processing of steps S41 up to S49 in FIG. 10.

In step S70, the CPU 41 sends both information on timbre of slapping, pitch of slapping and sound volume, and information on timbre, pitch of string picking and sound volume to the sound source 45. The processing of step S70 allows both a musical sound by string picking of a standard playing style and a musical sound by string picking of slapping to be generated at the same time. Therefore, it is possible to generate a musical sound more similar to that of actual slapping.

Sound Generation Detection Processing (Second Variation)

Figure 12:
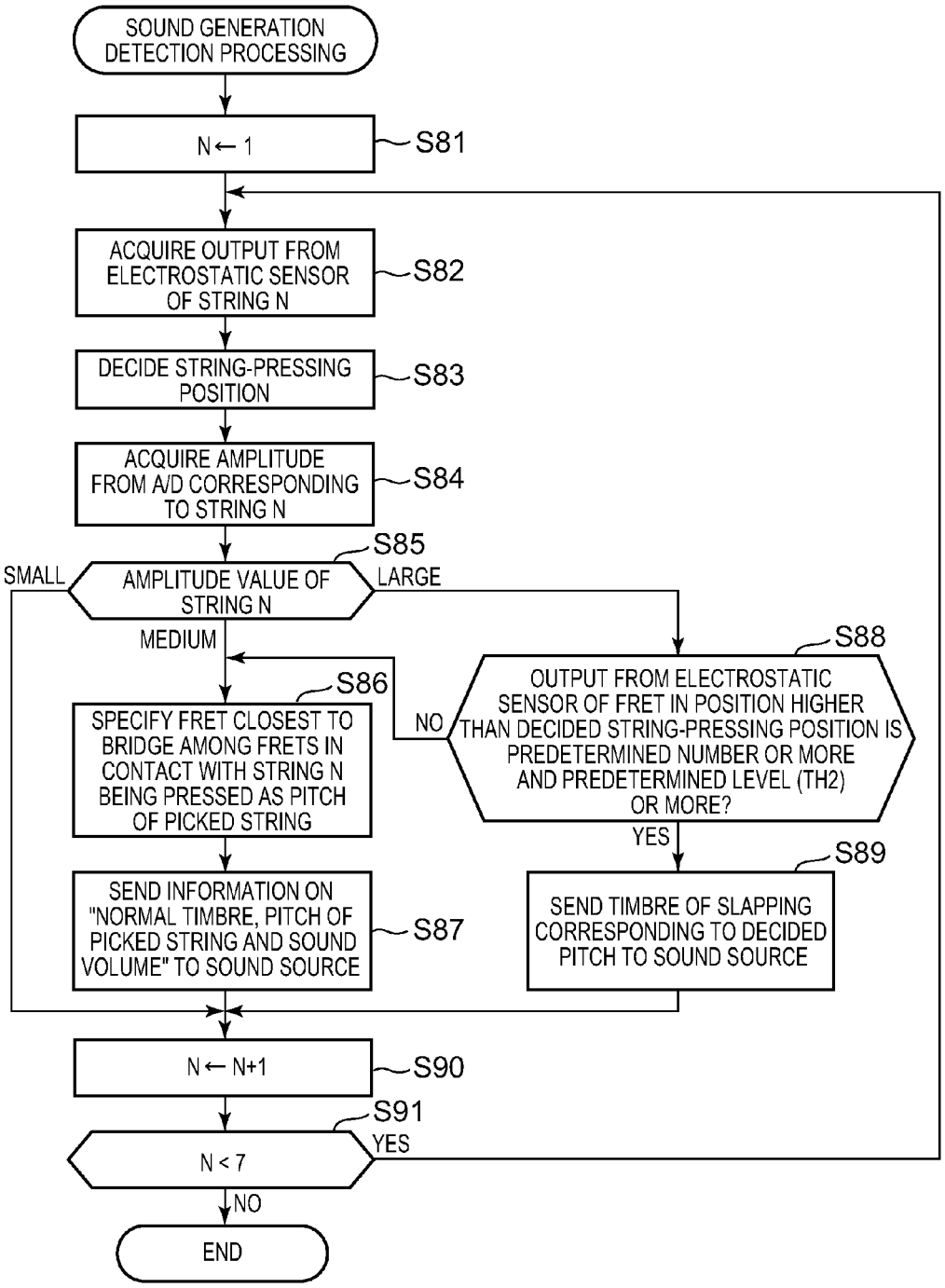
FIG. 12 is a flowchart showing a second variation of sound generation detection processing executed in the electronic stringed instrument according to the present embodiment.

FIG. 12 is a flowchart showing a second variation of sound generation detection processing (processing of step S31 in FIG. 9) executed in the electronic stringed instrument 1 according to the present embodiment. In the sound generation detection processing, the type of the string-pressing sensor 44 for detecting a string-pressing position based on output from an electrostatic sensor is used.

Initially, in step S81, the CPU 41 sets a variable N to 1. In step S82, the CPU 41 acquires an output value of an electrostatic sensor for each of the frets 23 corresponding to the string 22 of the string number N. In step S83, the CPU 41 decides a string-pressing position of the string 22 of the string number N. Specifically, the CPU 41 decides, in a case where an output value of an electrostatic sensor corresponding to each of the frets 23 of the string 22 of the string number N is a predetermined threshold (Th1) or more, that the fret 23 of the predetermined threshold (Th1) or more corresponds to the string-pressing position of the string 22 of the string number N. In step S84, the CPU 41 acquires an amplitude value from the A/D 54 corresponding to the string 22 of the string number N.

In step S85, the CPU 41 differentiates a transition destination of processing according to whether the amplitude value of the string 22 of the string number N is large, medium or small. Here, a large amplitude value indicates that an amplitude value is a first threshold or more. Moreover, a medium amplitude value indicates that an amplitude value is less than the first threshold and a second threshold or more. Furthermore, a small amplitude value indicates that an amplitude value is less than the second threshold. In a case where an amplitude value is large, the CPU 41 determines that slapping is possibly performed, and advances processing to step S88. In a case where an amplitude value is medium, the CPU 41 determines that slapping is not performed and a standard playing style is used, thus advances processing to step S86. In a case where an amplitude value is small, the CPU 41 determines that string picking is not performed, and advances processing to step S90.

In step S88, the CPU 41 decides the fret 23 closest to the bridge 16 among those of the string-pressing positions decided in step S83. Moreover, the CPU 41 determines whether or not there is a predetermined number or more of the output value that is a predetermined threshold (Th2) or more of an electrostatic sensor corresponding to the fret 23 of a fret number higher than that of the decided fret 23. Here, the threshold (Th2) is a value lower than the threshold (Th1). That is, the threshold (Th2) is a value lower than an electrostatic sensor value of the level determined as string-pressing. Because in step S88, an electrostatic sensor value indicating that the string 22 comes into contact with the fret 23 even without coming into contact with the fingerboard 21 is enough to determine whether or not slapping is performed. In a case where determination is YES in step S88, the CPU 41 determines that slapping is performed and advances processing to step S89. In step S89, the CPU 41 sends timbre of slapping corresponding to the decided pitch to the sound source 45. Thereafter, the CPU 41 advances processing to step S90.

In step S86, the CPU 41 decides, as pitch of string picking, pitch corresponding to the fret 23 closest to the bridge 16 among those in string-pressing positions decided in step S83. In step S87, the CPU 41 sends information on normal timbre, pitch of string picking and sound volume to the sound source 45.

In step S90, the CPU 41 increments N by 1. In step S91, the CPU 41 determines whether or not N is smaller than 7, and in a case where determination is YES, determines that contact of all strings with the fret 23 is not detected, and advances processing to step S82. On the other hand, in a case where determination is NO in step S91, the CPU 41 finishes the sound generation detection processing.

Sound Muting Detection Processing

Figure 13:
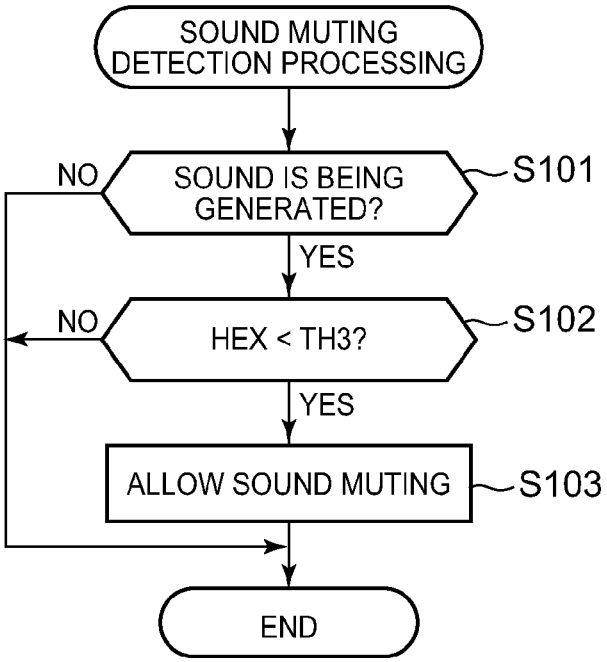
FIG. 13 is a flowchart showing sound muting detection processing executed in the electronic stringed instrument according to the present embodiment.

FIG. 13 is a flowchart showing sound muting detection processing (processing of step S32 in FIG. 9) executed in the electronic stringed instrument 1 according to the present embodiment.

Initially, in step S101, the CPU 41 determines whether or not the sound is being generated. In a case where determination is YES in this step, the CPU 41 advances processing to step S102, and in a case where determination is NO in this step, the CPU 41 finishes the sound muting detection processing. In step S102, the CPU 41 determines whether or not a vibration level of each string based on output from the hex pickup 12 is smaller than a predetermined threshold (Th3). In a case where determination is YES in this step, the CPU 41 advances processing to step S103, and in a case of NO in this step, the CPU 41 finishes the sound muting detection processing. In step S103, the CPU 41 turns on a sound muting flag. After the processing of step S103 is finished, the CPU 41 finishes the sound muting detection processing.

Pitch Extraction Processing

Figure 14:
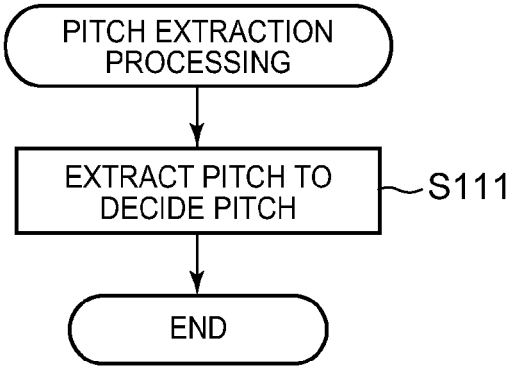
FIG. 14 is a flowchart showing pitch extraction processing executed in the electronic stringed instrument according to the present embodiment.

FIG. 14 is a flowchart showing pitch extraction processing (processing of step S33 in FIG. 9) executed in the electronic stringed instrument 1 according to the present embodiment.

In step S111, the CPU 41 extracts pitch by means of known art to decide pitch. Here, the known art includes, for example, a technique described in Japanese Unexamined Patent Application, Publication No. H1-177082. After the processing of the step S111 is finished, the CPU 41 finishes the pitch extraction processing.

A description has been given above concerning the configuration and processing of the electronic stringed instrument 1 of the present embodiment.

In the present embodiment, the CPU 41 determines whether or not the detected level of string picking strength exceeds a predetermined first level, and in a case of determining that the predetermined first level is exceeded, determines whether or not a condition is satisfied that the number of the frets 23 in contact with the string 22 detected as a picked string is a predetermined number or more (for example, 10 or more) while the frets in contact therewith as above are located within a predetermined area from the bridge 16 (for example, the fret number 18 or higher). In a case where it is determined that the condition is satisfied, the CPU 41 instructs the connected sound source 45 to generate a predefined slap sound.

Therefore, it is possible to realize slapping that obtains a percussive sound by beating a fingerboard with a string and which is heavily used with an actual stringed instrument.

Further, in the present embodiment, the CPU 41 instructs, in a case where the detected level of string picking strength exceeds a second level lower than the first level, the connected sound source 45 to generate a musical sound of pitch based on the string 22 detected as a picked string and the fret 23 closest to the bridge 16 among the frets 23 in contact with the detected string 22.

Therefore, for a playing style having string picking strength that is not so large compared to that of slapping, it is possible to decide pitch to generate sound as a normal playing style.

Moreover, in the present embodiment, the CPU 41 instructs, in a case where it is determined that the first level is exceeded, but it is determined that a condition is not satisfied that the number of the frets 23 in contact with the string 22 detected as a picked string is a predetermined number or more (for example, 10 or more) while the frets in contact therewith as above are located within a predetermined area from the bridge 16 (for example, the fret number 18 or higher), the connected sound source 45 to generate a musical sound of pitch based on the detected string 22 and the fret 23 closest to the bridge 16 among the frets 23 in contact with the detected string 22.

Therefore, for a playing style that does not meet the condition even in a case of having string picking strength equal to that of slapping, it is possible to decide pitch to generate sound as a normal playing style.

Furthermore, in the present embodiment, the CPU 41 instructs to generate a differential sound obtained by deducting a musical sound instructed to be generated from a slap sound to be eventually generated.

Therefore, it is possible to instruct only generation of a slap sound excluding a normal sound generation.

Additionally, in the present embodiment, the CPU 41 specifies as pitch of a differential sound, in a case where the detected level of string picking strength does not exceed the second level, pitch decided based on the string 22 detected as a picked string and a fret closest to the bridge 16 among the frets 23 in contact with the detected string 22.

Therefore, in a case where string picking strength does not reach the level of sound generation, it is possible to decide only pitch of a slap sound as a differential sound.

Further, in the present embodiment, the CPU 41 detects whether or not each of the strings 22 is in contact with each of the frets 23.

Therefore, it is possible to accurately determine whether or not slapping is performed.

A description has been given above concerning embodiments of the present invention, but these embodiments are merely examples and are not intended to limit the technical scope of the present invention. The present invention can have various other embodiments, and in addition various types of modification such as abbreviations or substitutions can be made within a range that does not depart from the scope of the invention. These embodiments or modifications are included in the range and scope of the invention described in the present specification and the like, and are included in the invention and an equivalent range thereof described in the scope of the claims.

What is claimed is:

1. An electronic stringed instrument, comprising:

a plurality of strings stretched above a fingerboard unit provided with a plurality of frets;

a state detection unit that detects a state between each of the plurality of frets and each of the plurality of strings;

a string picking detection unit that detects picking of any of the plurality of strings while detecting strength of detected string picking;

a level determination unit that determines whether or not the level of string picking strength detected by the string picking detection unit exceeds a predetermined first level;

a condition determination unit that determines, when the level determination unit determines that the predetermined first level is exceeded, whether or not a condition is satisfied that there are a plurality of frets simultaneously in contact with the string detected as a picked string by the string picking detection unit through the state detection unit; and a slap sound generation instruction unit that instructs, when the condition determination unit determines that the condition is satisfied, a sound source to generate a predefined slap sound.

2. The electronic stringed instrument according to claim 1, wherein the plurality of strings are stretched from above a fingerboard unit provided with a plurality of frets toward a bridge unit while the string picking detection unit is provided adjacent to the bridge unit, and the condition determination unit determines whether or not a condition is satisfied that the fret in contact with the string is located within a predetermined area from the bridge unit.

3. The electronic stringed instrument according to claim 1, further comprising:

a first normal sound generation instruction unit that instructs, in a case where the level of the string picking strength detected by the level determination unit exceeds a second level lower than the first level, the connected sound source to generate a musical sound of pitch based on a string detected as a picked string by the string picking detection unit and a fret closest to the bridge unit among frets in contact with the detected string, through the state detection unit.

4. The electronic stringed instrument according to claim 1, further comprising:

a second normal sound generation instruction unit that instructs, in a case where it is determined that the first level is exceeded, but it is determined that the condition is not satisfied, the connected sound source to generate a musical sound of pitch based on a string detected as a picked string by the string picking detection unit and a fret closest to the bridge unit among frets in contact with the detected string, through the state detection unit.

5. The electronic stringed instrument according to claim 3, wherein the slap sound generation instruction unit instructs to generate a differential sound obtained by deducting a musical sound instructed to be generated by the first normal sound generation instruction unit from a slap sound to be eventually generated.

6. The electronic stringed instrument according to claim 5, further comprising:

a differential sound pitch specification unit that specifies as pitch of the differential sound, in a case where the level of string picking strength detected by the level determination unit does not exceed the second level, pitch decided based on a string detected as a picked string by the string picking detection unit and a fret closest to the bridge unit among frets in contact with the detected string.

7. The electronic stringed instrument according to claim 1, wherein the state detection unit detects whether or not each of the strings is in contact with each of the frets.

8. A musical sound generation method used in an electronic stringed instrument, the electronic stringed instrument including: a plurality of strings stretched above a fingerboard unit provided with a plurality of frets; a state detection unit that detects a state between each of the plurality of frets and each of the plurality of strings; and a string picking detection unit that detects that any of the plurality of strings is picked while detecting the strength of detected string picking, the method comprising:

determining whether or not the level of string picking strength detected by the string picking detection unit exceeds a predetermined first level;

determining by the state detection unit, in a case where the predetermined first level is exceeded, whether or not a condition is satisfied that there are a plurality of frets simultaneously in contact with the string detected as a picked string by the string picking detection unit through the state detection unit; and instructing, in a case where the condition is satisfied, a sound source to generate a predefined slap sound.

9. The musical sound generation method according to claim 8, wherein the plurality of strings are stretched from above a fingerboard unit provided with a plurality of frets toward a bridge unit while the string picking detection unit is provided adjacent to the bridge unit, and it is determined whether or not a condition is satisfied that the fret in contact with the string is located within a predetermined area from the bridge unit.

10. The musical sound generation method according to claim 8, further comprising:

instructing, in a case where the detected level of the string picking strength exceeds a second level lower than the first level, a sound source to generate a musical sound of pitch based on the string detected as a picked string and a fret closest to a bridge unit among frets in contact with the detected string.

11. The musical sound generation method according to claim 8, further comprising:

instructing, in a case where it is determined that the first level is exceeded, but the condition is not satisfied, the connected sound source to generate a musical sound of pitch based on the string detected as a picked string by the string picking detection unit and a fret closest to the bridge unit among frets in contact with the detected string, through the state detection unit.

12. The musical sound generation method according to claim 10, wherein an instruction is given for generating a differential sound obtained by deducting the musical sound instructed to be generated from the slap sound to be eventually generated.

13. The musical sound generation method according to claim 12, further comprising:

specifying as pitch of the differential sound, in a case where the detected level of string picking strength does not exceed the second level, pitch decided based on a string detected as a picked string and a fret closest to the bridge unit among frets in contact with the detected string.

14. The musical sound generation method according to claim 8, wherein it is detected whether or not each of the strings is in contact with each of the frets.

15. A non-transitory storage medium storing a program configured to cause a computer used in an electronic stringed instrument, the electronic stringed instrument including: a plurality of strings stretched above a fingerboard unit provided with a plurality of frets; a state detection unit that detects a state between each of the plurality of frets and each of the plurality of strings; and a string picking detection unit that detects picking of any of the plurality of strings while detecting strength of detected string picking, to execute:

a level determination step of determining whether or not the level of string picking strength detected by the string picking detection unit exceeds a predetermined first level;

a condition determination step of determining, in a case where it is determined in the level determination step that the predetermined first level is exceeded, whether or not a condition is satisfied that there are a plurality of frets simultaneously in contact with the string detected as a picked string by the string picking detection unit through the state detection unit; and a slap sound generation instruction step of instructing, in a case where it is determined in the condition determination step that the condition is satisfied, a sound source to generate a predefined slap sound.

16. The non-transitory storage medium according to claim 15, wherein the plurality of strings are stretched from above a fingerboard unit provided with a plurality of frets toward a bridge unit while the string picking detection unit is provided adjacent to the bridge unit, and the condition determination unit determines whether or not a condition is satisfied that the fret in contact with the string is located within a predetermined area from the bridge unit.

17. The non-transitory storage medium according to claim 15, configured to further execute a first normal sound generation instruction step of instructing, in a case where the level of the string picking strength detected in the level determination step exceeds a second level lower than the first level, the sound source to generate a musical sound of pitch based on the string detected as a picked string in the state detection step and a fret closest to the bridge unit among frets in contact with the detected string.

18. The non-transitory storage medium according to claim 15, configured to further execute a second normal sound generation instruction step of instructing, in a case where it is determined that the first level is exceeded, but the condition is not satisfied, the connected sound source to generate a musical sound of pitch based on the string detected as a picked string in the state detection step and a fret closest to the bridge unit among frets in contact with the detected string.

19. The non-transitory storage medium according to claim 17, wherein in the slap sound generation instruction step, an instruction is given for generating a differential sound obtained by deducting the musical sound instructed to be generated in the first normal sound generation instruction step from a slap sound to be eventually generated.

20. The non-transitory storage medium according to claim 19, further comprising:

a differential sound pitch specification step of specifying as pitch of the differential sound, in a case where the level of string picking strength detected in the level determination step does not exceed the second level, pitch decided based on the string detected as a picked string and a fret closest to the bridge unit among frets in contact with the detected string.

21. The non-transitory storage medium according to claim 15, wherein the state detection unit detects whether or not each of the strings is in contact with each of the frets.

* * * * *